United States Patent [19]

Hulme

[11] 3,938,080

[45] Feb. 10, 1976

[54] SYSTEM FOR THE PROGRAMMED FLASHING OF WARNING LIGHTS

[75] Inventor: Edwin C. Hulme, Coogee, New South Wales, Australia

[73] Assignees: Kurt W. Thurston, Sparks, Nev.; William L. Selig, Lafayette, Calif. ; part interest to each

[22] Filed: June 3, 1974

[21] Appl. No.: 475,575

[52] U.S. Cl. ..... 340/114 B; 325/16; 343/228

[51] Int. Cl.[2] ..... E01F 9/00

[58] Field of Search ..... 340/22, 23, 28, 32, 41 A, 340/45, 46, 82, 90, 114 R, 114 B, 33; 116/63 R; 325/16; 343/228

[56] References Cited

UNITED STATES PATENTS

| | | | |
|---|---|---|---|
| 3,257,641 | 6/1966 | Campana et al. | 340/33 |
| 3,506,959 | 4/1970 | Nunn | 340/114 |
| 3,577,122 | 5/1971 | Lapham | 340/114 |
| 3,867,718 | 2/1975 | Moe | 340/31 R |

*Primary Examiner*—John W. Caldwell
*Assistant Examiner*—James J. Groody
*Attorney, Agent, or Firm*—Flehr, Hohbach, Test, Albritton & Herbert

[57] ABSTRACT

A system for the programmed flashing of a plurality of highway warning lights includes a plurality of slave receivers each associated with a warning light to be mounted on respective barricades along with one or more master transmitters associated with certain receivers and warning lights. The master transmitter provides a coded signal which causes the warning lights to flash either in synchronization or in a predetermined sequence. Fail safe operation is provided by the use of a substitute master if the original master is disabled. The programmed flashing provides for greater depth perception by the approaching driver.

12 Claims, 6 Drawing Figures

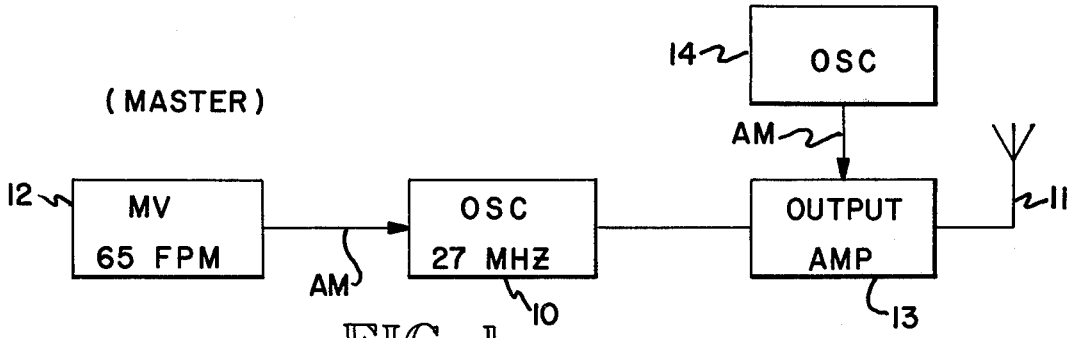
FIG. 1
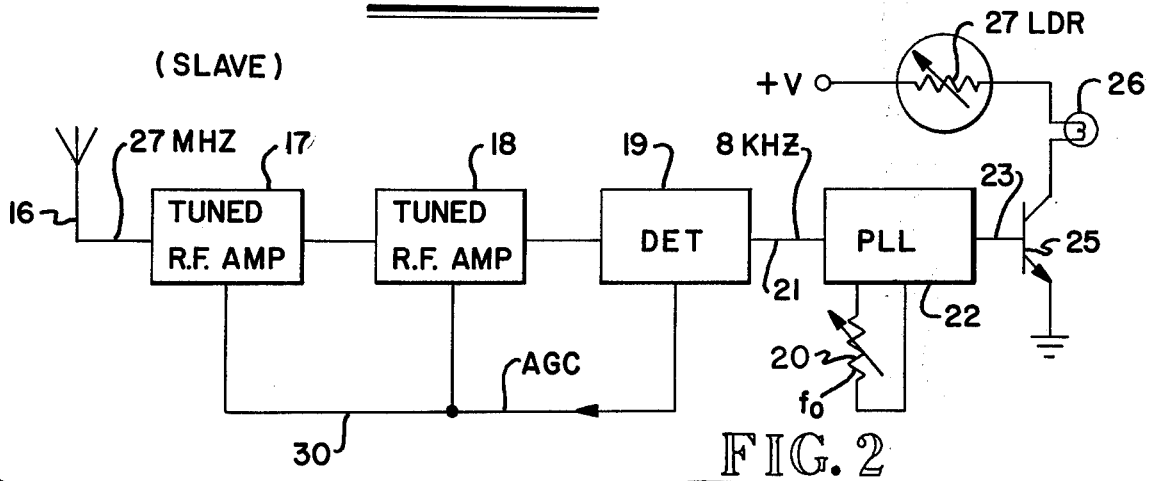
FIG. 2
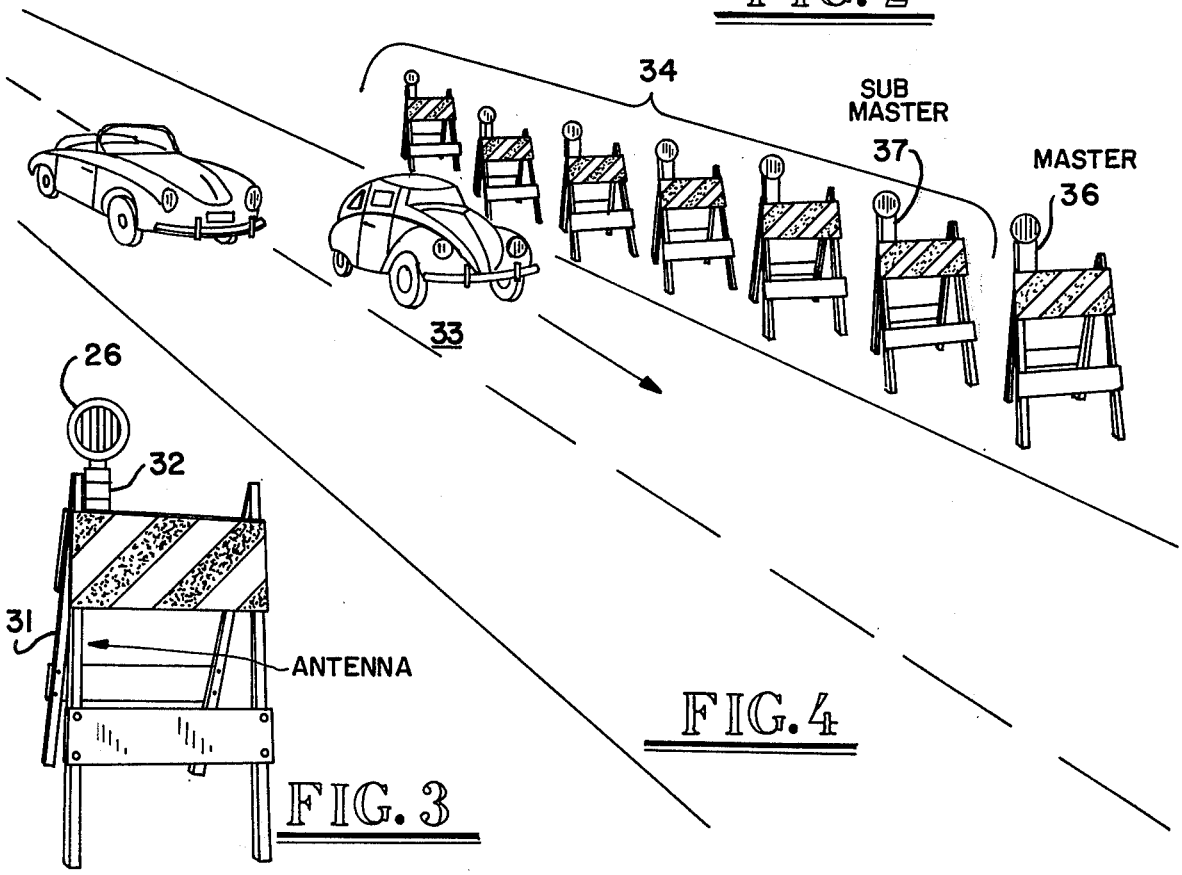
FIG. 4
FIG. 3

SYSTEM FOR THE PROGRAMMED FLASHING OF WARNING LIGHTS

BACKGROUND OF THE INVENTION

The present invention is directed to a system for the programmed flashing of warning lights and more particularly to a system which is particularly useful for warning lights which form a portion of a highway barricade.

Where a number of amber flashing or warning lights are used in conjunction with a highway barricade, the lights flash randomly or indiscriminately presenting a confusing fire-fly type scene to the approaching driver. One of the major difficulties is that the lights do not provide any depth perception or direction or delineation. In fact, the indiscriminate flashing of warning lights is so misleading to the driver that they are prohibited in many instances.

Where highway construction is in progress it is impractical to provide wired or interconnected arrangements because of the expense involved and the necessity for placement of the lights at different locations depending on the progress of the highway construction.

OBJECTS AND SUMMARY OF THE INVENTION

It is, therefore, a general object of the present invention to provide a system for the programmed flashing of warning lights.

It is a more specific object to provide a system which is easily used, is portable and where the flashing may either be synchronized or sequential.

It is another object of the invention to provide a system as above which is fail safe in operation due to either failure of some circuit component or to actual physical destruction of a portion of the system.

In accordance with the above objects there is provided a system for the programmed flashing of a plurality of highway warning lights which includes a master transmitter means which provides a coded electromagnetic signal to control the warning lights. Receiving means are associated with each of the warning lights for receiving and decoding the signal and flashing the light associated with the receiving means in accordance with the code.

BRIEF DESCRIPTION OF THE DRAWINGS

FIG. 1 is a block diagram of a master transmitter used in the present invention;

FIG. 2 is a block diagram of a slave receiver used in the present invention;

FIG. 3 is a perspective view of a typical highway barricade employing a warning light embodying the present invention;

FIG. 4 is a simplified perspective view of a typical layout of a warning light system embodying the present invention;

DETAILED DESCRIPTION OF THE PREFERRED EMBODIMENT

Figure 5:
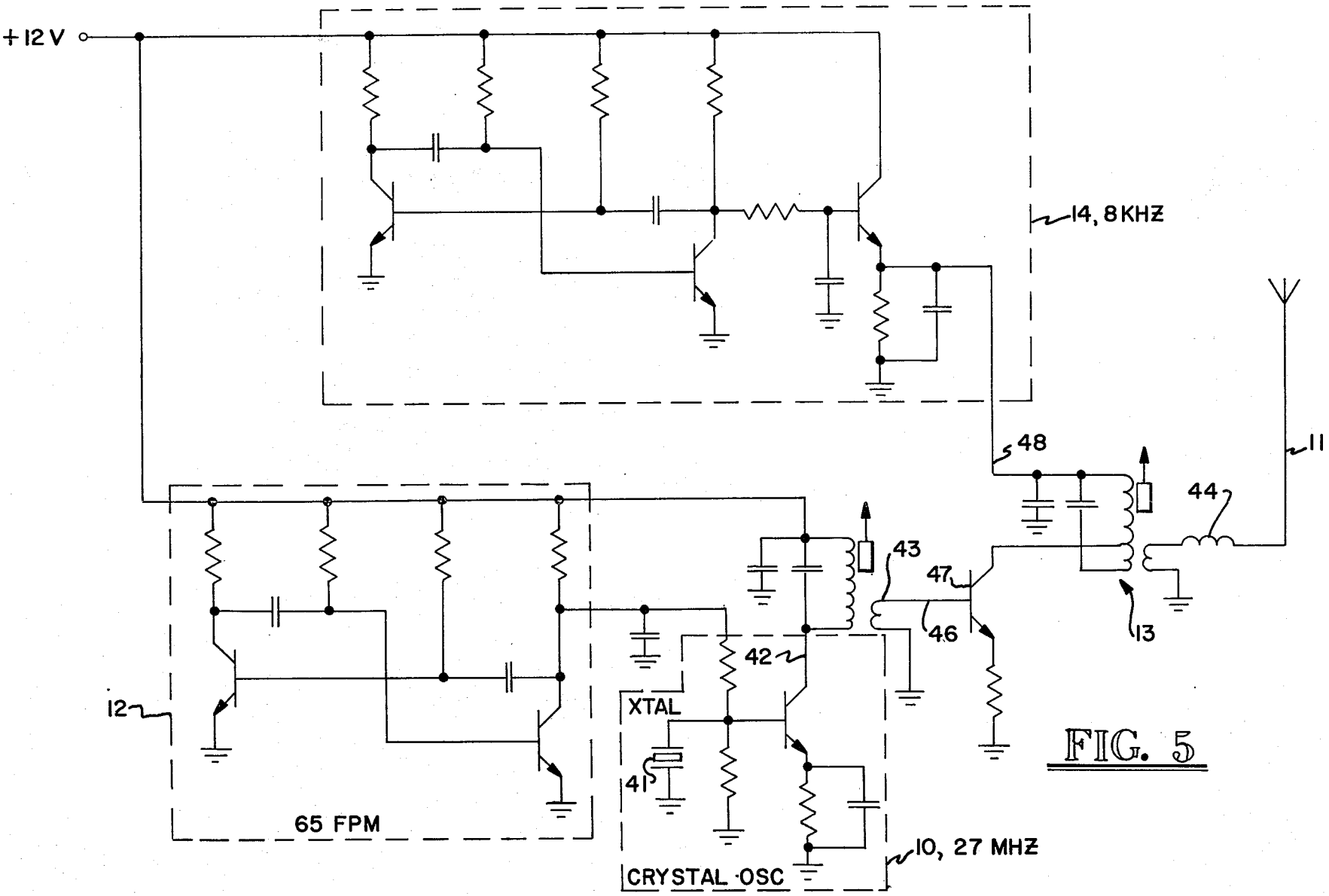
FIG. 5 is a detailed circuit schematic of the master transmitter of FIG. 1.

The master transmitter which provides a coded electromagnetic signal for controlling the warning lights is illustrated in FIG. 1 and basically by means of an oscillator 10 generates a 27 MHz carrier signal which is transmitted to the warning lights through the antenna 11. The 27 MHz conforms with Federal Communications Commission (FCC) requirements of the United States government for the operation of low power communication devices. However, as will be discussed below, because this wavelength falls within the citizens radio service band, extra precautions must be taken to reject any interfering signals. Other frequencies in the low, medium and high frequency bands and also in the UHF and VHF bands may be used depending upon legal requirements of the particular locality and application.

Still referring to FIG. 1, a multivibrator 12 having a frequency of 65 flashes per minute (FPM) or 1.08 Hz amplitude modulates, with substantially 100% modulation, the signal of oscillator 10. As will be discussed below, multivibrator 12 determines the on time of the warning lights and thus the duty cycle or on time of the 65 FPM pulse may be adjusted accordingly.

Oscillator 10 is coupled to an output amplifier 13 which also has, as an amplitude modulating input, the output of a multivibrator 14 which provides an 8 kHz signal. The composite signal which is in effect a carrier which has two amplitude modulated signals imposed on it is transmitted via antenna 11 to the receiver antenna 16, one of which is illustrated in FIG. 2. Each warning light has a separate receiver associated with it.

The composite signal is decoded by means of two stages of tuned RF amplification 17 and 18 whose output is detected by detector 19 which decodes or amplitude demodulates the signal from the master transmitter to provide a signal on line 21 which is a carrier signal of 8 kHz, amplitude modulated by a 65 FPM (flashes per minute) signal. The 8 kHz signal is connected to a phase locked loop 22 which has a free running frequency $f_0$ of 8 kHz which is fixed by potentiometer 20. The phase locked loop in accordance with well known theory amplitude demodulates the input signal on line 21 and provides on its output line 23 the final 65 FPM pulse signal. This drives the base of a switching transistor 25 whose collector is tied to an associated warning light 26 to activate the light in accordance with the duty cycle or on time of the 65 FPM signal.

A light dependent resistor 27 couples the light 26 to a voltage supply only during dark ambient conditions. The biasing of transistor 25 is such that it is normally on or conductive and is turned off by the 65 FPM pulse. Thus if the 65 FPM pulse on line 23 is not received, light 26 will be continuously activated to thereby provide fail safe operation.

The detector 19 also includes automatic gain control means which are coupled back to the tuned RF amplifiers 17 and 18 by the line. This prevents overload where a receiving station is in close proximity to a master transmitter.

The slave receiver of FIG. 2 is shown as it would be mounted in FIG. 3 on a barricade 31. The container 32 may contain either a single slave or receiving station along with the warning light or in addition, a master transmitter. In other words, as illustrated in FIG. 4 which is a typical orientation of warning lights along a highway 33, there may be a conglomerate of slaves 34 in which two or three master transmitters will also be provided. The activated master station is shown at 36 which also includes a slave.

In case the master-slave station 36 is disabled because of a collision with an automobile, a substitute master 37 is activated to continue the driving of the remaining slaves 34. This is accomplished as will be discussed in detail below by the fail safe nature of the operation of the warning lights. In other words, if the existing master is disabled, the remaining warning lights will be continuously illuminated and time delay means are provided to sense this continuous illumination and sequentially activate the substitute master.

In some cases where only a small group of lights are used only a single master transmitter may be suitable. That is, if this transmitter is disabled a steady illumination of all lights is acceptable.

Again referring to FIG. 3, an antenna for the master stations is provided by metallic strips embedded in the legs of the barricade 31; alternatively the antenna may be formed by the two metal legs of the barricade. For this type of antenna the legs may or may not be insulated from the ground with plastic cups. Also in accordance with United States Federal Communications Commission requirements the antenna length must not exceed 5 feet. Alternative antenna arrangements could be antenna strip sandwiched between wood faces of the barricade.

Referring now to FIG. 5 which is a detailed schematic of the master transmitter of the present invention the blocks of FIG. 1 are illustrated in dashed outline with the same reference numerals. Oscillator 10 is crystal controlled and includes a crystal 41 which provides a 27 MHz frequency. Instead of crystal control the oscillator may utilize inductance-capacitance or resistance-capacitance control. The output of oscillator 10 on line 42 is coupled through a tank circuit 43 to output amplifier 13 which is coupled to antenna 11. The coupling is through a loading coil 44. Specifically the oscillator 41 drives the base input 46 of a transistor amplifier 47 which is a portion of the output amplifier 13. This amplifier is amplitude modulated by oscillator 14 on line 48.

Oscillator 10 is amplitude modulated at a 100% level or in effect switched on and off by the multivibrator 12 which operates at approximately 65 FPM. As discussed above, multivibrator 12 determines the flashing rate and on time of the warning lights. The duty cycle and the flashing rate may be varied by varying the time constants of the multivibrator. Both the frequency and duty cycle of multivibrator 12 can, of course, be modified by adjustment of the associated feedback resistors and capacitors in accordance with well-known multivibrator theory. Such adjustments may be made at the factory or alternatively adjusting potentiometers may be provided for on-site adjustment.

With the simultaneous or synchronized operation of the lights, the on time of the lights, which was normally 20% may be reduced to 10% to conserve battery energy sources. The reduction of on time is made possible by the fact that the total light output is increased due to the simultaneous flashing of the lights.

In operation, the transmitter of FIG. 5 provides a signal on the antenna 11 which has a carrier of 27 MHz which has superimposed on it two amplitude modulation signals; namely 65 FPM from the multivibrator 12 and 8 kHz from multivibrator 14. The purpose of the 8 kHz signal, which collector modulates the final output transistor 47 of amplifier 13, is to provide sufficient coding to avoid interference from other transmitters in the field and also to obtain a high audio selectivity. As discussed above, this is especially important because of the 27 MHz signal which is in the citizens band.

Figure 6:
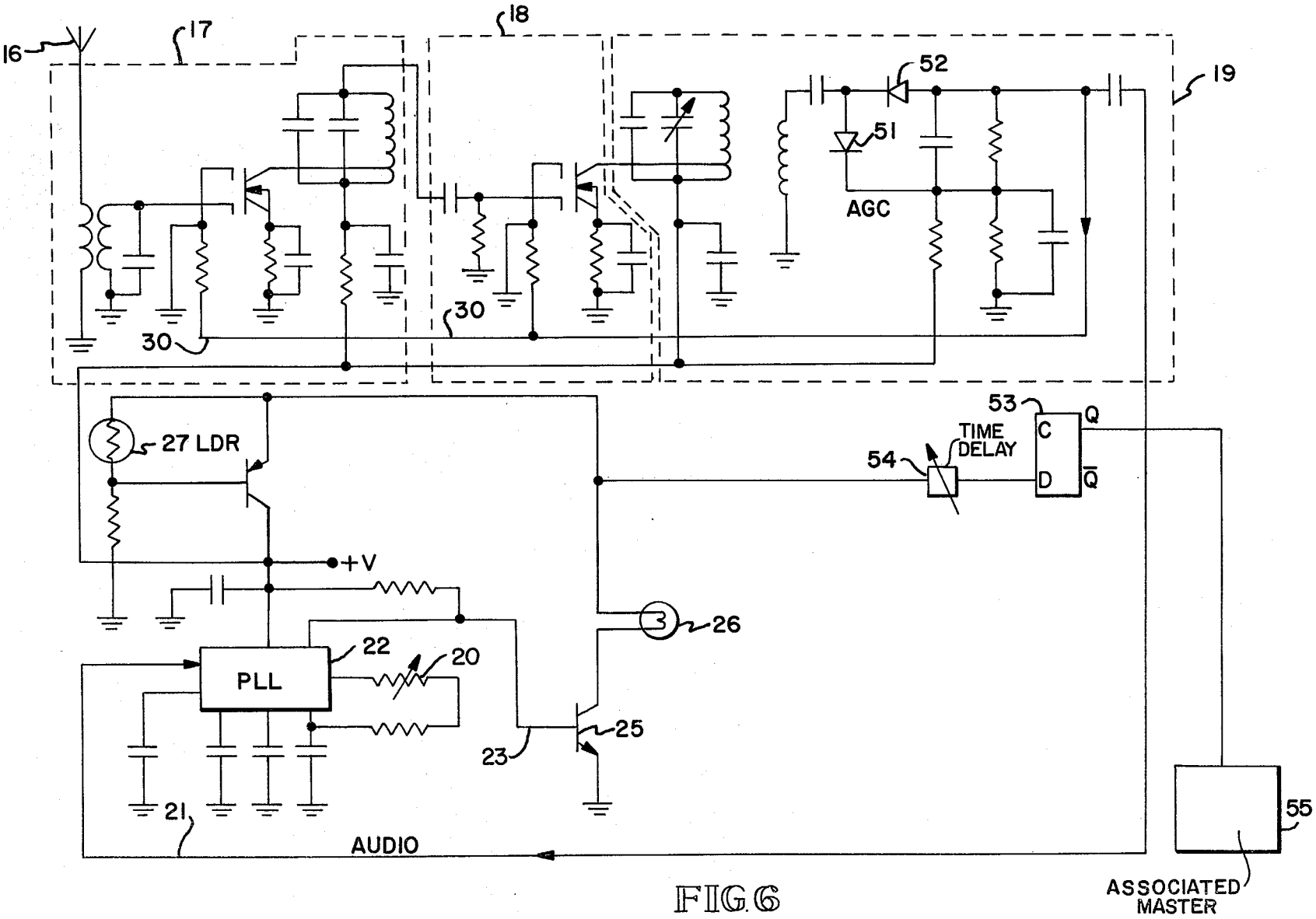
FIG. 6 is a detailed circuit schematic of the slave receiver of FIG. 2.

Referring now to FIG. 6 which illustrates a typical slave receiver of FIG. 2 and in combination with a master transmitter of FIG. 1, the antenna 16 receives the coded signal from a master transmitter which is filtered by tuned RF amplifiers 17 and 18. The tuned RF amplifiers provide for increased gain and a sensitivity in the range of 35 microvolts. AGC feedback on line 30 which is provided by the diode 51 prevents overload where the slave is in close proximity to the master transmitter. Detection by detector 19 is provided substantially by the diode 52.

The RF amplifiers 17 and 18 and detector 19 form a tuned radio frequency tuner which is commercially available, for example, under model ZN414 from the Ferranti Corporation. Alternatively, a super heterodyne configuration may be used which, however, must be highly selective. Thus, for example, the super heterodyne would utilize mechanical filters or resonators for the intermediate frequency portion of its circuitry. In any case, it is important to avoid interference from other transmitters which are either driving warning lights in other portions of the construction area or from nearby citizen band transmitters to provide high interference rejection In the preferred embodiment along with the tuned radio frequency section 17, 18, 19, the 8 kHz output of detector 19 is coupled to a phase locked loop circuit 22 on line 21. It is illustrated as a standard integrated circuit chip which is available from many electronics suppliers. The free running frequency of the phase locked loop is adjusted by the potentiometer circuit 20 to the 8 kHz frequency. It is believed that the phase locked loop provides a highly selective circuit arrangement. In addition, the phase locked loop is relatively inexpensive compared to a super heterodyne arrangement and has a simplified setup procedure. The output of the phase locked loop on line 24 drives the switching transistor which has its collector coupled to a warning light 26. As discussed above, fail safe operation is provided by the warning light being in an on condition unless a signal is received on line 23. Transistor 25 is normally in an on or conductive condition. The light dependent resistor 27 supplies power to the light 26 during dark ambient conditions.

In accordance with the invention, sequential activation means are provided for sequentially activating respective transmitters in response to failure of a previously activated transmitter. This includes, as illustrated in FIG. 6, the flip-flop 53 which may be of the D-type, for example, which is coupled through a time delay means 54 to the power input of the warning light. The output of flip-flop 53 drives activating circuit to associated master 55 which is in the same physical location as the slave receiver. If the previously activated master is disabled either because of electrical circuit failure or being physically disabled by, for example collision with an automobile, the time delay 54 which, for example, may be 2, 5 or 10 seconds senses the on condition of light 26 for this predetermined time and activates flip-flop 53 to cause the associated master 55 to begin transmitting the coded signal. It is, of course, apparent that if two or three substitute masters such as 55 are included in the conglomerate of slave receivers that the time delay circuit 54 would be selectively adjusted to cause sequential activation of the master stations.

With the above circuit as shown the plurality of slaves 34 as illustrated in FIG. 4 would flash in exact synchronization. This is believed to be the preferred type of warning light indication for most circumstances. However, the system can be utilized for sequential flashing by the use of a ring oscillator with a phase locked loop demodulator which is synchronized by the master pulse signal. More specifically, the ring oscillator (14 of FIG. 1) would provide 99 different frequencies spaced a suitable value apart such as 250 Hz. The phase locked loop demodulator for each light would have its free running frequency adjusted to a unique frequency of the ring oscillator.

Thus the present invention has provided an improved warning light system where each unit is physically independent with no interconnection and means are provided to avoid interference from other sources and for fail safe operation. With the use of either simultaneous or sequential flashing, depth perception, direction and delineation is improved for the motorist.

In addition to the illustrated use of the present invention is signalling and controlling traffic lanes, in all aspects the invention is also useful for marine marker buoys and at airports. The audio selectivity provided by the 8 kHz modulation, or other frequencies, is also useful for the control of remote controlled model airplanes when interference from nearby control stations is a problem.

I claim:

1. In a system for operating warning lights disposed along a street or highway traveled by a motorist, a plurality of spaced barricades, a plurality of warning lights respectively carried by said barricades and positioned along the street or highway to provide a warning to a motorist, said lights to be controlled in a pattern as to give an impression of depth to the motorist along the lane of travel by the motorist, each of said warning lights having a power supply, a lens assembly and a lamp mounted in the lens assembly, master transmitter means for providing an electromagnetic signal which is transmitted through the air; receiving means associated with said warning lights for receiving said transmitted signal and for intermittently connecting said lamp to said power supply so that the warning lights are flashed to give a perception of depth along the line of travel by the motorist.

2. A system as in claim 1 where each of said receiving means is continuously responsive to said electromagnetic signal so that the warning lights are flashed simultaneously at a rate controlled by said code.

3. A system as in claim 1 where each of said receiving means is responsive to said electromagnetic signal so that the warning lights are flashed in a continuous sequence beginning with the first warning light encountered by the motorist in the plurality of warning lights.

4. As system as in claim 1 wherein the barricades are constructed with at least one member formed of a conducting material and wherein the master transmitter means is mounted upon one of the barricades and is coupled to said one member so that said one member serves as an antenna.

5. A system as in claim 4 wherein the master transmitter is mounted on the same barricade as one of said plurality of warning lights.

6. A system for the programmed flashing of a plurality of temporarily positioned highway warning lights controlled in a pattern to give a perception of depth to a motorist comprising: receiving means mounted with each of said warning lights for receiving and decoding a frequency coded electromagnetic signal said receiving means including energizing means responsive to said receipt of said electromagnetic signal for energizing said warning lights; master transmitter means for providing said electromagnetic signal for continuously actuating directly said energizing means and being in a stationary position with respect to said receiving means and being sufficiently close to said plurality of warning lights so that said flashing of said lights is controlled concurrently and continuously by said master transmitter in accordance with said code.

7. A system as in claim 1 where at least one other of said receiving means is mounted with a substitute master transmitter means together with means for activating said substitute transmitter means in response to absence of a signal from a previously activated master transmitter means.

8. A system as in claim 7 where one other of said receiving means includes fail safe means for maintaining the respective warning light on when no signal is received and where said activation means includes time delay means responsive to said on condition for activating an associated substitute master transmitter after a predetermined time period.

9. A system as in claim 1 where each of said receiving means includes automatic gain control means.

10. A system as in claim 1 where said receiving means includes means for rejecting interfering signals.

11. A system as in claim 10 where said master transmitter means includes a carrier oscillator and first and second modulating means for modulating the carrier signal of said oscillator said first means providing a modulating signal for continuously actuating directly said energizing means and said second means providing a modulating signal to prevent interference from other transmitters and where said rejecting means includes a phase locked loop having a free running frequency equal to the frequency of said second modulating signal included in said master transmitter signal.

12. A system as in claim 1 where each of said receiving means include fail safe means for maintaining the respective warning light on when no signal is received.

* * * * *